US010669051B2

(12) United States Patent
Frabetti et al.

(10) Patent No.: US 10,669,051 B2
(45) Date of Patent: Jun. 2, 2020

(54) PRODUCT PACKAGING ASSEMBLY

(71) Applicant: CMFIMA S.R.L., Imola (IT)

(72) Inventors: Fabio Frabetti, Bologna (IT); Luca Baraldi, Bologna (IT)

(73) Assignee: CMFIMA S.R.L., Imola (IT)

( * ) Notice: Subject to any disclaimer, the term of this patent is extended or adjusted under 35 U.S.C. 154(b) by 682 days.

(21) Appl. No.: 15/172,405

(22) Filed: Jun. 3, 2016

(65) Prior Publication Data

US 2016/0355284 A1 Dec. 8, 2016

(30) Foreign Application Priority Data

Jun. 4, 2015 (EP) ..... 15425041
Sep. 7, 2015 (EP) ..... 15183991

(51) Int. Cl.

| | |
|---|---|
| ***B65B 11/00*** | (2006.01) |
| ***B65B 35/18*** | (2006.01) |
| ***B65C 9/10*** | (2006.01) |
| ***B65C 3/26*** | (2006.01) |
| ***B65C 9/20*** | (2006.01) |
| ***B65B 51/06*** | (2006.01) |
| ***B65B 25/00*** | (2006.01) |
| ***B65B 11/54*** | (2006.01) |

(52) U.S. Cl.

CPC ..... *B65B 11/004* (2013.01); *B65B 11/54* (2013.01); *B65B 25/005* (2013.01); *B65B 51/06* (2013.01); *B65C 3/26* (2013.01); *B65C 9/10* (2013.01); *B65C 9/20* (2013.01)

(58) Field of Classification Search

CPC ..... B65B 51/06; B65B 11/004; B65B 11/54; B65B 25/005; B65C 3/26; B65C 9/10; B65C 9/20

See application file for complete search history.

(56) References Cited

U.S. PATENT DOCUMENTS 2,005,340 A * 6/1935 Jaffin ..... B41M 1/24 101/28
2,592,246 A * 4/1952 Cloud ..... B31B 70/00 493/417
2,685,911 A * 8/1954 Haller ..... B29C 59/02 428/184
2,744,370 A * 5/1956 Seragnoli ..... A23G 7/0012 53/228

(Continued)

FOREIGN PATENT DOCUMENTS

EP 0 608 824 A1 8/1994
EP 1 897 810 A1 3/2008

(Continued)

OTHER PUBLICATIONS

Extended European Search Report dated Nov. 9, 2016 received in European Patent Application No. 15 18 3991.7.

*Primary Examiner* — Alex M Valvis
*Assistant Examiner* — David G Shutty
(74) *Attorney, Agent, or Firm* — Scully, Scott, Murphy & Presser, P.C.

(57) ABSTRACT

An assembly for packaging products including at least one line for supplying the products to be packaged, at least one dispenser of covering sheets, a plurality of handling devices for juxtaposing a sheet on a respective product, and at least one output line for the packaged products.

10 Claims, 5 Drawing Sheets

(56) References Cited

U.S. PATENT DOCUMENTS 3,753,640 A * 8/1973 Duepree ..... B29C 57/00 425/392
3,797,198 A * 3/1974 Fukuzaki ..... B65B 11/34 53/209
4,240,865 A * 12/1980 Kyts ..... B29C 65/20 100/33 PB
4,807,426 A * 2/1989 Smith ..... B29C 65/18 156/515
5,493,847 A * 2/1996 Spatafora ..... B65B 11/32 53/234
5,519,981 A * 5/1996 Fukusaki ..... B65B 11/44 221/233
5,775,060 A * 7/1998 Ferrero ..... B31F 1/20 53/453
5,819,647 A * 10/1998 Balosh ..... B44B 5/0038 101/31.1
6,189,300 B1 * 2/2001 Le ..... B65B 9/067 53/374.4
7,111,424 B1 * 9/2006 Moody ..... F41A 23/08 42/72
2004/0025469 A1 * 2/2004 Scaliti ..... B65B 11/54 53/138.1
2004/0037927 A1 * 2/2004 Liempd Van ..... B65B 9/06 426/106
2004/0226267 A1 * 11/2004 Mansuino ..... B65B 9/067 53/450
2009/0038977 A1 * 2/2009 Tilton ..... B65D 73/0057 206/469
2009/0133367 A1 * 5/2009 Gregerson ..... B65B 47/02 53/453
2010/0239721 A1 * 9/2010 Stoppello ..... A23G 7/0012 426/106
2011/0268371 A1 * 11/2011 Kristal ..... B29C 66/4312 383/5
2014/0083055 A1 * 3/2014 Rodrigues ..... B65B 11/44 53/465
2018/0016042 A1 * 1/2018 Kimoto ..... B65B 11/54

FOREIGN PATENT DOCUMENTS

EP 1897810 A1 * 3/2008 ..... B65B 11/54
EP 1897810 A1 * 3/2008 ..... B65D 75/18
EP 1897811 A1 * 3/2008 ..... B65B 51/065
WO 2011/163050 A1 12/2011
WO 2014/076627 A1 5/2014

* cited by examiner

PRODUCT PACKAGING ASSEMBLY

The present invention relates to a product packaging assembly.

In the field of product packaging, the technology is known which allows to package each individual product by means of a respective wrapper that wraps around it, said wrapper being coupled to close by means of adhesive labels and/or glues that are distributed appropriately.

This production technology allows to obtain packages that differ almost exclusively in the color and quality of the wrapper or, at most, in an applied adhesive label.

In any case, especially for food products, the individual package has the purpose of protecting the product contained therein and of avoiding any contaminations thereof.

Packages of the known type allow to identify cases in which the package has already been opened and therefore the product may potentially have been exposed to contaminants There are in fact packages that have safety seals (such as for example the above cited label) or comprise a pre-scoring lines which, as a consequence of the opening of the package, undergo a structural modification (breakage, damage or modification of the shape and/or dimensions) that makes it evident that opening has occurred.

However, packages of the known type offer no safety as regards the complete segregation of the product contained therein with respect to the outside environment and therefore are not suitable to avoid in an absolute manner any contaminations of the product.

Specifically, no wrapper packages are known which isolate the product completely from the outside environment and more particularly there are no packaging assemblies capable of providing wrappers with such characteristics.

The aim of the present invention is to solve the problems described above, by devising a product packaging assembly that is suitable to provide a wrapper that isolates the product completely from the outside environment, eliminating the risk of contamination caused for example by the passage of air from the inside to the outside of the wrapper and/or vice versa.

Within this aim, an object of the invention is to devise a product packaging assembly that is suitable to provide wrappers that have a high-value appearance and high quality standards.

Another object of the invention is to devise a product packaging assembly that is provided with means or other seals that show assuredly any tampering or opening of the provided package.

Another object of the invention is to devise a product packaging assembly that provides a wrapper, even partially similar to those of the known type, by adopting a technical and structural architecture that is alternative to that of packaging machines of the known type.

A further object of the present invention is to provide a product packaging assembly that has low costs, is relatively simple to provide in practice and is safe in application.

This aim and these objects are achieved by a product packaging assembly of the type comprising at least one line for supplying the products to be packaged, at least one dispenser of covering sheets, a plurality of handling devices for juxtaposing a said sheet on a respective product, and at least one packaged product output line, characterized in that said handling devices comprise:

- at least one movable gripper for picking up at least one individual product from said at least one supply line and for aligning it with at least one respective packaging sheet;

- at least one pusher for the translation of said at least one product along a trajectory that is incident to said at least one respective sheet aligned therewith and with folding contrasts of said at least one sheet along said at least one product;
- at least one pair of clamping jaws for the forced juxtaposition of the mutually opposite flaps of said at least one sheet, the surfaces of said jaws that abut against said at least one sheet having a complementarily shaped embossing for the penetration of the raised portions of one jaw in the complementary recesses of the other jaw and vice versa, with the interposition of said flaps;
- at least one abutment for folding the portions of said juxtaposed flaps that are arranged at the sides of said product, with consequent alignment of said flaps with one face of said at least one product so as to constitute a bundle of gathered flaps;
- at least one contoured clamping plate for the transverse compaction of said bundle of gathered flaps, said at least one plate being provided with at least one heater for the controlled increase of its temperature.

Further characteristics and advantages of the invention will become better apparent from the description of a preferred but not exclusive embodiment of the product packaging assembly according to the invention, illustrated by way of nonlimiting example in the accompanying drawings, wherein.

Figure 1:
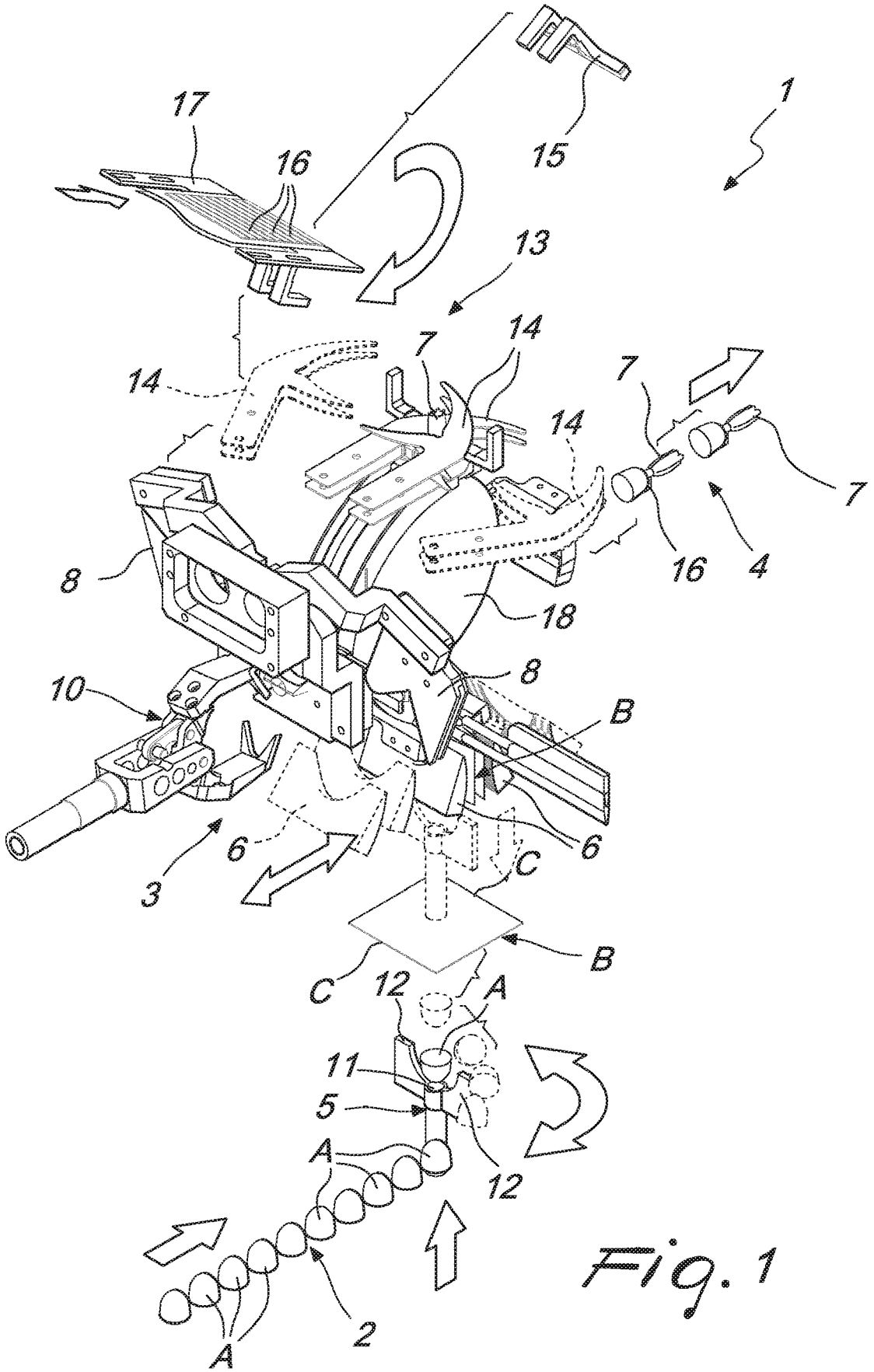
FIG. 1 is a rear lateral axonometric view of a product packaging assembly according to the invention.
Figure 2:
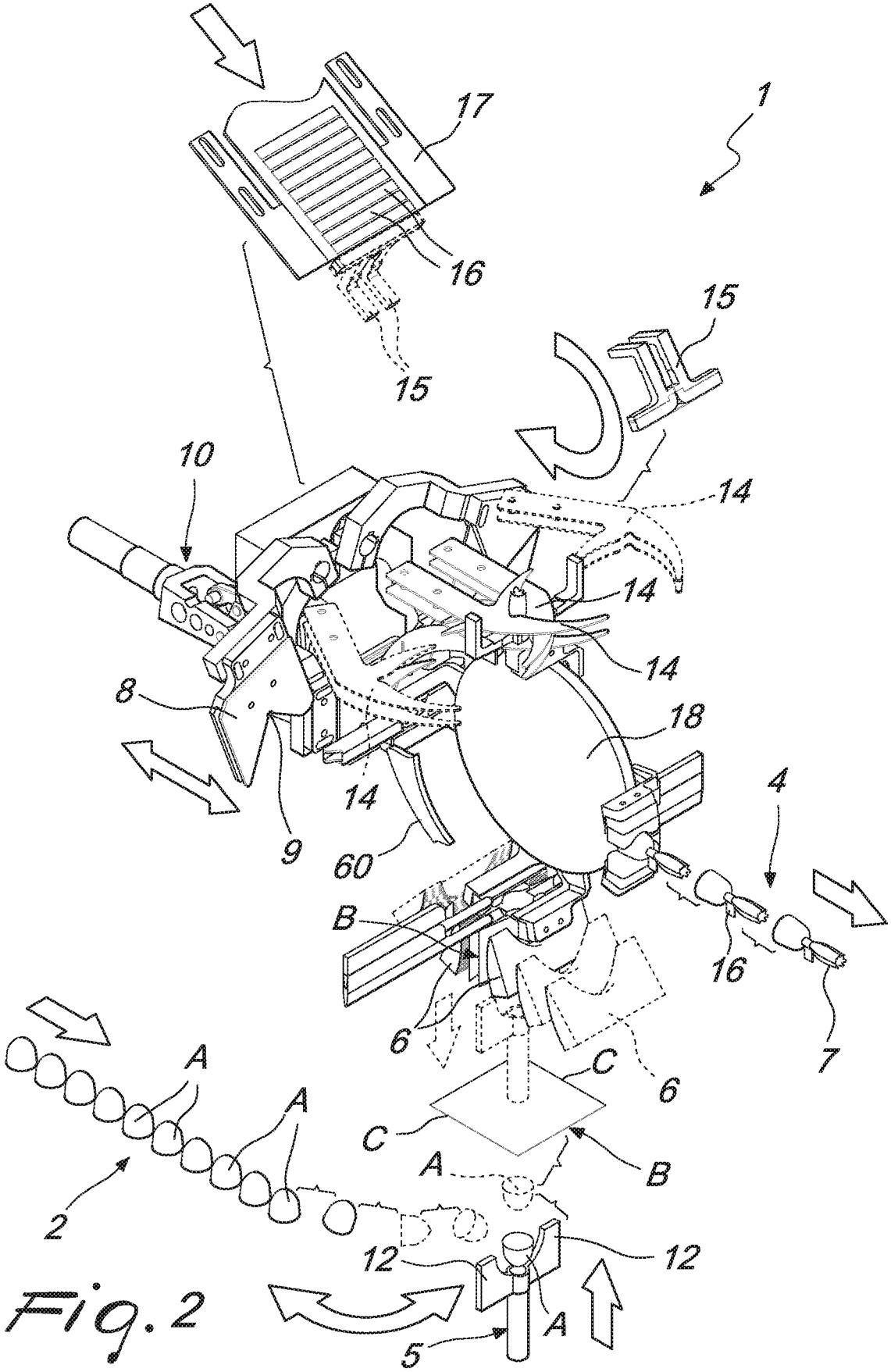
FIG. 2 is a front lateral axonometric view of a product packaging assembly according to the invention.
Figure 3:
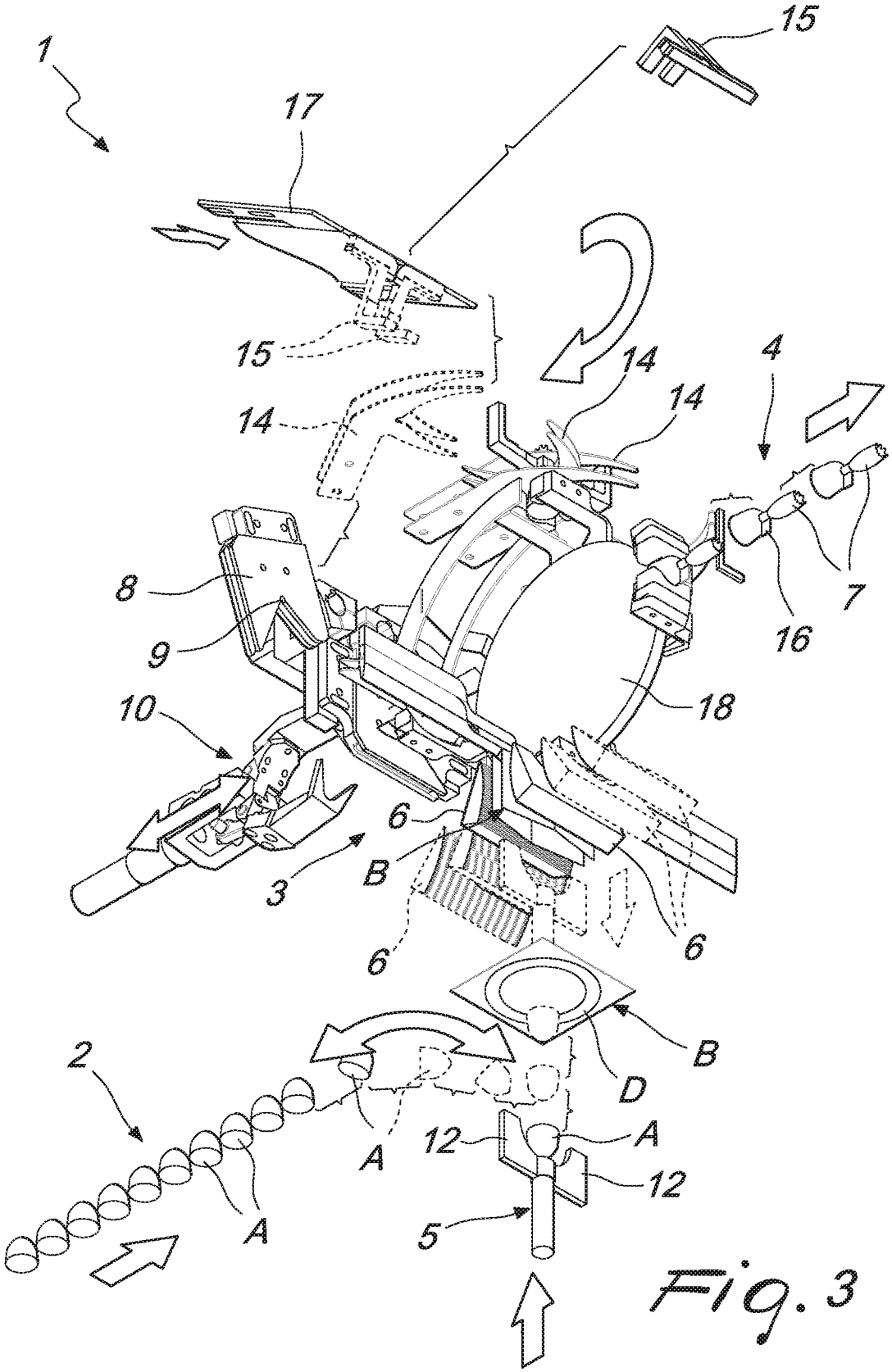
FIG. 3 is a front lateral axonometric view, taken from below, of a product packaging assembly according to the invention.
Figure 4:
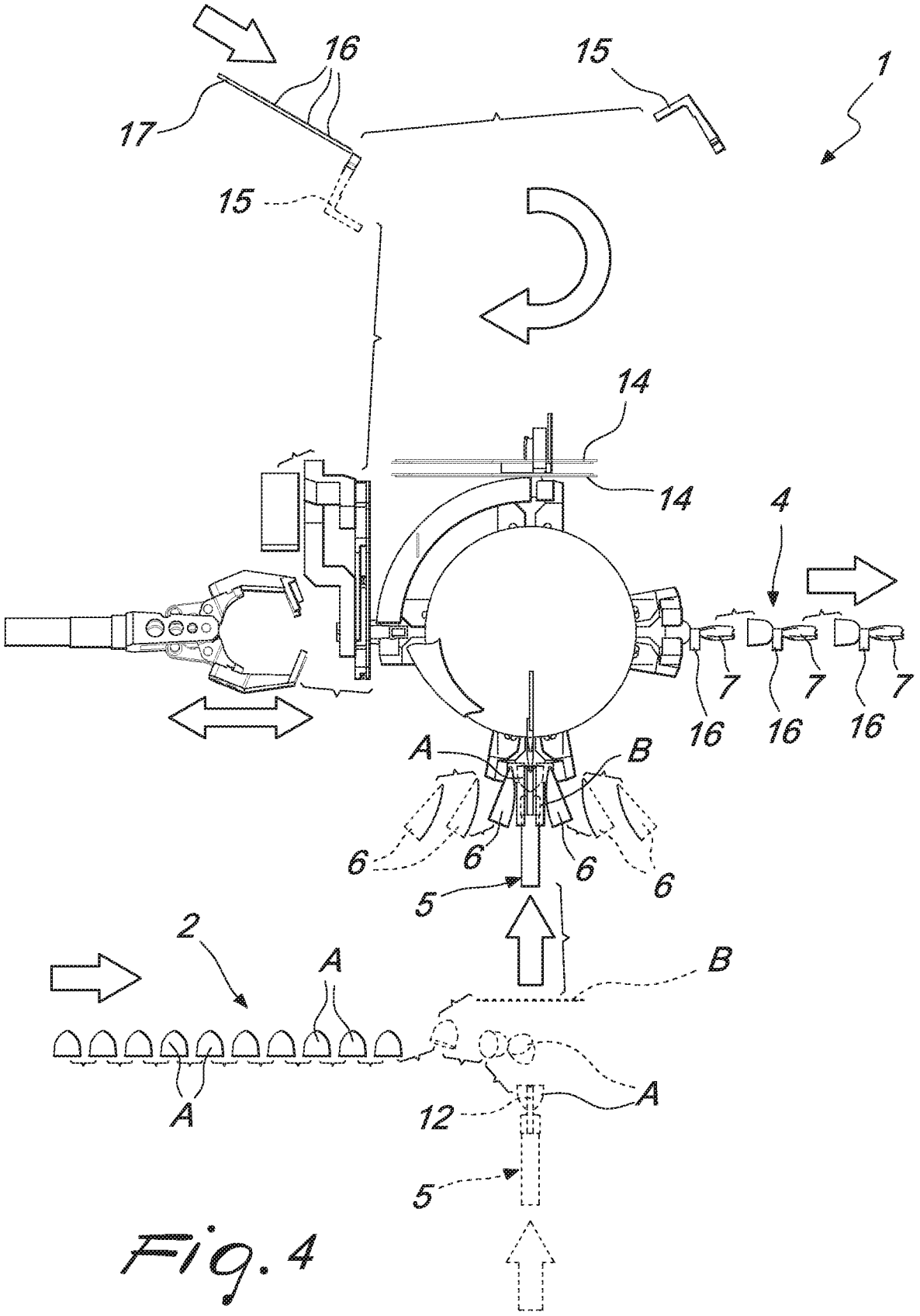
FIG. 4 is a side view of a product packaging assembly according to the invention.
Figure 5:
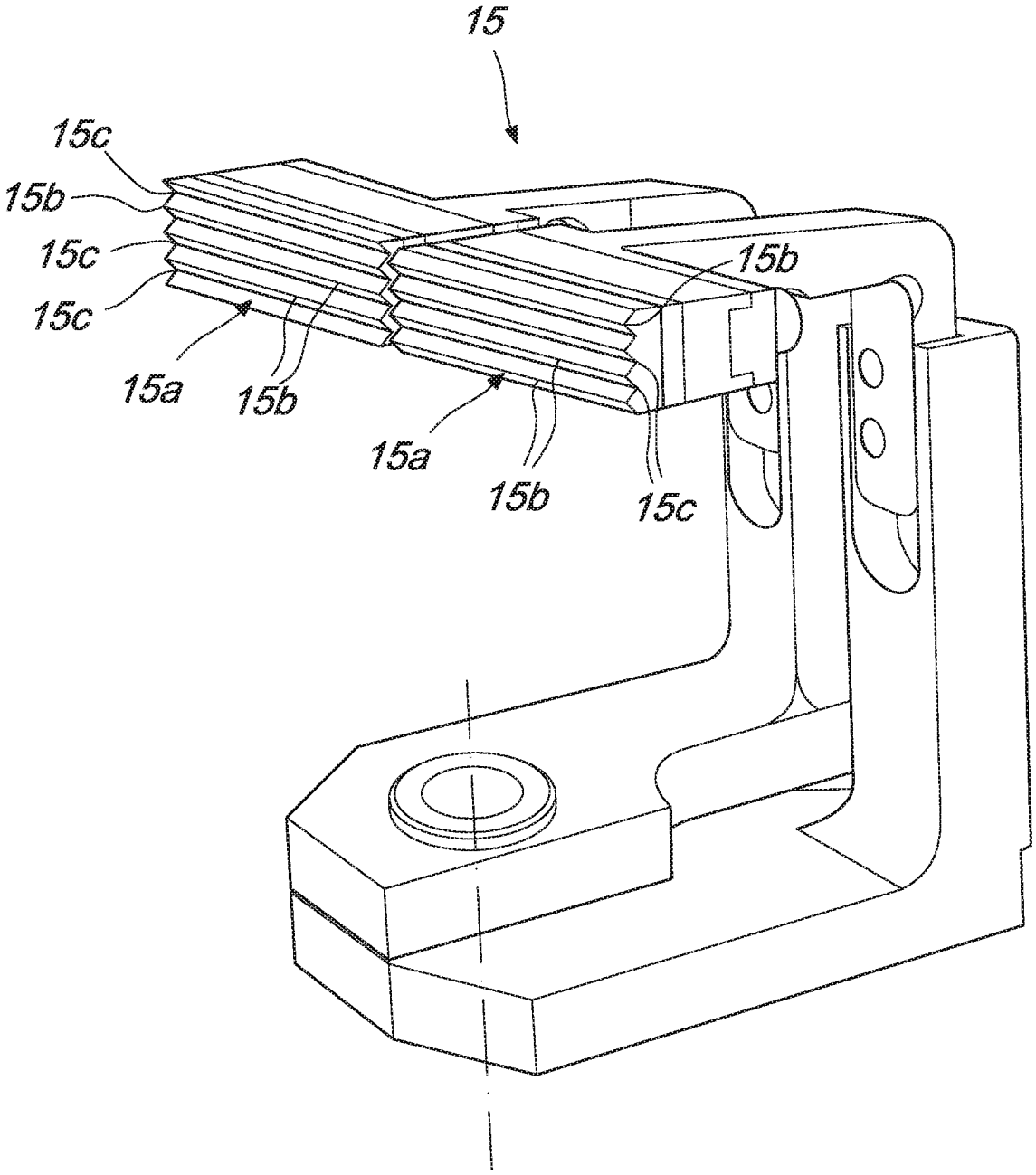
FIG. 5 is an enlarged-scale axonometric view of the product packaging assembly according to the invention.

With particular reference to the figures, the numeral 1 generally designates an assembly for packaging products A.

It is specified that in the examples shown in the accompanying figures and in the description that follows, reference shall be made predominantly to an assembly 1 for packaging chocolates, candy, cookies and food products in general.

Obviously, the assembly 1 according to the invention can be used likewise to package other products A that require similar packaging specifications.

The assembly 1 for packaging products A comprises at least one line 2 for supplying the products A to be packaged, at least one dispenser of covering sheets B, a plurality of handling devices 3 for juxtaposing a sheet B on a respective product A, and at least one line 4 for the exit of the packaged products A.

According to the invention, the handling devices 3 comprise a plurality of mutually cooperating components.

In particular, there is at least one movable gripper for picking up at least one individual product A from the at least one supply line 2 and for aligning said product with at least one respective packaging sheet B. The movable gripper is therefore a device intended for so-called "pick and place" of products and as such can be chosen among those of the known type in accordance with the specific requirements.

The handling devices 3 comprise further at least one pusher 5 for the translation of the at least one product A along a trajectory that is incident to the at least one respective sheet B that is aligned therewith: said trajectory also provides for the crossing of folding contrasts (not shown in the accompanying figures since they are of a substantially known type) of the at least one sheet B along the at least one respective product A.

By way of example, it is specified that the folding contrasts might be constituted by rigid bodies intended to affect the flaps C of the sheet B during their passage (moved by the pusher 5): usually, the rigid bodies used as contrasts are laminas or bars and provide for the presence of brushes or bristles or generic elastically deformable protrusions on their surface intended to interact with the sheet B in order to force the sheet B onto the product A to ensure correct juxtaposition.

Furthermore, the handling devices 3 comprise at least one pair of clamping jaws 6 for the forced juxtaposition of the mutually opposite flaps C of the at least one sheet B.

In practice, by clamping the flaps C of the sheet B onto each other it is possible to achieve a perfect covering of the product A.

In particular, if the sheet has, on its surface intended to make contact with the product A (exclusively in the regions of the flaps C that will not make direct contact with the product A), bonding and/or adhesive substances D (and/or substances with a similar function), the jaws 6 ensure the perfect coupling of the facing and juxtaposed flaps C so that the bonding substances (and/or equivalents) that are present are mutually coupled hermetically.

In this manner it is possible to ensure that the product A arranged within the sheet B is isolated from the outside environment: the adhesive substances D (or equivalents) in fact ensure that the product A is sealed within the sheet B.

Moreover, the jaws 6, by progressively approaching the sheet B superimposed on the product A, also facilitate the expulsion of most of the air initially interposed between the product A and the sheet B (inside the package being formed): in the case of food products, the expulsion of the air is extremely advantageous, since it reduces the presence of oxygen in contact with the product A, minimizing oxidation processes and creating an environment that is unfavorable for the proliferation of bacteria and fungi. Of course, the fact that the package (wrapped sheet B) is subsequently sealed onto the product A by means of the adhesive substance D (or equivalent) arranged on the sheet B eliminates the possibility of gas exchanges between the inside of the package and the outside (thus preventing the entry of oxygen).

It should be specified that in order to ensure optimum coupling of the mutually clamped flaps C (with the optional and advantageous interposition of an adhesive substance D or equivalent), the surfaces of the jaws 6 that abut against the at least one sheet B have respective complementarily shaped embossing.

This method of providing the surfaces of the jaws 6 causes the penetration of the raised portions of a first jaw 6 in the complementarily shaped recesses of the other jaw and vice versa, with the interposition of the flaps C of the sheet B. The clamping of the sheets is therefore particularly efficient, ensuring an optimum hermetic coupling thereof (by way of the presence of the adhesive substance D or equivalent).

Furthermore, the handling devices 3 comprise at least one abutment, for the folding of the portions of the juxtaposed flaps C arranged at the sides of the product A, with consequent alignment of the flaps with one face of the at least one product A so as to constitute a bundle 7 of gathered flaps C.

Downstream of the clamping jaws 6, the covered product A has a fan-like shape: substantially, the flaps C of the covered product A, shaped like a fan, arrange themselves beyond the plane that contains the base of said product A. According to a particular embodiment that allows to convey them outwardly in order to be able to ensure the action of the subsequent handling devices 3, it is necessary to provide for the presence of a specific abutment constituted by two elements 60 that move along a rectilinear path in a substantially radial direction (with respect to the arrangement of the partially packaged product A). The two elements 60 slide at the sides of the partially packaged product A and convey the heat-sealed flaps C, which are particularly rigid, so as to be able to ensure that the subsequent handling devices 3 act on the outside of the wrapper being formed. The two elements 60 can be simply shaped like two parallelepipeds arranged at the distance that allows exclusively the passage of the covered product A. Actually, preferably they can be contoured so as to better convey the flaps C of the sheet B that are arranged in a fan-like shape. It is possible to provide for the insertion, between the jaws 6 and the elements 60, of guides for the product A that have the purpose of assisting the conveyance of the flaps C: the presence of such guides is in any case to be considered optional and not relevant for the purposes of the operation of the assembly 1.

Finally, it should be specified that the handling devices 3 comprise at least one contoured clamping plate 8 for the transverse compaction of the bundle 7 of gathered flaps C.

The at least one plate 8 is provided with at least one heater for the controlled increase of its temperature.

The fact that the plate 8 is heated allows to render uniform the distribution of the adhesive substance D on the mutually coupled flaps C, facilitating an optimum coupling that ensures the perfect seal against gas exchanges between the inside of the package and the outside environment.

The contoured clamping plates 8 are two in number, are substantially mutually opposite and can move from a configuration of maximum mutual separation to a configuration of at least partial juxtaposition.

In the configuration of at least partial juxtaposition of the plates 8, the bundle 7 of gathered flaps C is interposed and clamped between corresponding perimetric regions of said plates 8.

It is useful to point out that each plate 8 can effectively have a substantially V-shaped recess 9 in its end edge.

Such recess 9 faces the bundle 7 of gathered flaps C.

The perimetric regions suitable to clamp the bundle 7 of flaps C are defined substantially at the vertex of the V-shaped recess 9.

The two plates 8, during clamping, substantially behave like a sort of guillotine intended to minimize the transverse space occupation of the bundle 7 of flaps C, therefore compacting said flaps C (until the gaps that are present between the flaps C are substantially eliminated): this clamping increases the quality of the coupling between said flaps C (with the interposition of the adhesive substance D and/or equivalent) in order to ensure the optimum tightness of said coupling (intended to avoid also gas exchanges from the inside to the outside of the package).

According to a particular constructive solution of unquestionable interest in practice and in application, the assembly 1 comprises specific rotatable grip means 10 which face the bundle 7 of gathered flaps C and are substantially aligned with the plates 8 when they are in the at least partially juxtaposed configuration.

The rotatable grip means have the purpose of clamping the free end of the bundle 7 of the flaps C and of rotating it with respect to the product A covered by the remaining portion of sheet B, with consequent further compaction of at least one part of the bundle 7 of gathered flaps C.

The twisting of the bundle 7 in fact produces a compaction thereof (at the twisted region).

The twisting of the bundle 7 can be performed before or after the clamping performed with the heated plates 8.

According to a specific application, it has been found that performing twisting with the rotatable grip means 10 before the clamping of the plates 8 allows later (i.e., during the clamping of said heated plates 6) to achieve a better overall compaction of the package and therefore to ensure perfect isolation of the product A packaged with the sheet B with respect to the outside environment.

With particular reference to an embodiment that ensures high quality standards of the final package, the contoured pusher 5 can comprise a unit 11 for retaining the product A which is arranged substantially at its centerline.

In turn, the retention unit 11 is provided with laminar lateral protrusions 12 for the alignment of the lateral flaps C of the sheet B during the crossing of the folding contrasts.

The lateral protrusions 12 are contoured so as to have a respective edge that is aligned with the bottom of the product A, so as to ensure that, during the folding of the sheet B induced by the folding contrasts, the sheet B remains with the folded edge aligned with the bottom of the product A, avoiding creases or irregular folding of said sheet B (which might compromise the correct seal of the package being prepared).

By observing the accompanying figures, it can be noted that the contoured protrusions 12 can have a height that increases in a radial direction, the maximum value of which (which corresponds to the height at which the bottom of the product A retained by the unit 11 is located) is at the maximum distance from said unit.

It is deemed useful to specify that an embodiment that allows to obtain a package that is particularly refined and valuable from an aesthetic standpoint entails that the embossed surfaces of the jaws 6 comprise a plurality of consecutive and alternating ridges and grooves (of the type of a scored, toothed surface and the like): each ridge of the surface of a first jaw 6 is aligned with a respective groove of the surface of the second jaw 6 and each groove of the surface of a first jaw 6 is aligned with a respective ridge of the surface of the second jaw 6.

In this manner, the compression of the two flaps C onto each other (with the interposition of the adhesive substance D or equivalent) is optimum and ensures perfect tightness of their coupling.

In order to increase further the quality of the coupling between the two flaps C at the jaws 6, their embossed surfaces are preferably made of elastically deformable material, of a type chosen preferably among elastomers, polymers and the like.

It is useful to point out that the assembly 1 comprises, downstream of the at least one heated clamping plate 8, a labeling unit 13 provided with means 14 for locking the bundle 7 of gathered flaps C and at least one apparatus 15 for picking up and gluing the labels 16.

Such apparatus 15 can move from a first configuration for picking up at least one individual label 16 from a respective dispenser 17 (pickup configuration, in which the apparatus 15 is aligned with said dispenser 17), to a second configuration for the application of the label 16 on the bundle 7 of gathered flaps C (application configuration, in which the apparatus 15 is aligned with said bundle 7).

The apparatus 15 comprises two contoured elements, which pick up the label 16 from the dispenser 17, accommodating it on a surface that is defined by two aligned and contiguous faces thereof.

During the application of the label 16 to the bundle 7, the two elements mutually space and rotate around the bundle 7 on opposite sides thereof so as to cover it completely.

Once complete covering has been performed, the two faces that retained the label 16 are juxtaposed so as to facilitate the mutual coupling of the end parts of said label 16 (which thus constitutes an actual closure seal for the produced package).

It should be specified that in order to improve the adhesion of the label 16 and prevent it from detaching subsequently (on the finished product, for example when it is put on sale), the surfaces 15*a* for accommodating the label 16 of the apparatus 15 preferably comprise a plurality of complementary and mated protrusions 15*b* and recesses 15*c*.

In particular, it is possible to detect the presence of a series of consecutive protrusions 15*b* and recesses 15*c* (which determine a substantially undulated shape of said surfaces, constituted by a sequence of protrusions and recesses) on each surface 15*a*.

The fact that the protrusions 15*b* and the recesses 15*c* are complementary and mated entails that, by arranging face to face and aligning the two surfaces 15*a* of the two jaws of the apparatus 15, the protrusions 15*b* of a first surface 15*a* are aligned with the recesses 15*c* of a second surface 15*a*.

More specifically, during the clamping of the label 16 on the bundle 7 of gathered flaps C, each protrusion 15*b* of a first surface 15*a* is accommodated at least partially within a respective recess 15*c* of a second surface 15*b* and vice versa.

This particular shape ensures that the label 16 is subjected to forcing on the bundle 7 of flaps C due to the partial mutual penetration of the surfaces 15*a* of the apparatus 15.

In this manner it is possible to ensure an optimum adhesion of the labels 16 and therefore a higher uniformity and regularity of the packaged finished products.

It is specified that the best results can be obtained by using inserts made of elastically deformable material (for example an elastomer) to constitute the surfaces 15*a* (and therefore also the corresponding protrusions 15*b* and recesses 15*c*).

The use of deformable materials ensures a mutual adaptation of the shape of the protrusions 15*b* and of the recesses 15*c* when they are mutually clamped.

The movable gripper (intended to pick up the products A from the supply line 2 and deliver them to the pusher 5) preferably comprises a fixed main body, with respect to which an arm on which the supporting rod of said clamp is pivoted can rotate.

The clamp therefore can move, integrally with the arm, with respect to the main body, from a configuration of alignment with the at least one supply line 2 to pick up at least one individual product A to a configuration of alignment with at least one respective packaging sheet B.

Furthermore, said clamp is also movable, integrally with respect to the respective supporting rod, from a configuration for picking up at least one individual product A to a configuration for delivering the at least one individual product A, which is rotated through 180° with respect to the pickup configuration.

In this manner the clamp can also rotate the product A to deliver it to the pusher 5 according to the arrangement that is suitable for correct packaging thereof.

The assembly 1 according to the invention comprises further at least one transfer wheel 18, which is provided, on its substantially perimetric edge, with retention means for the product A covered by the sheet B arranged with the bundle 7 of gathered flaps C radially directed outwardly.

With particular reference to assemblies intended for the handling of food products and/or delicate products, at least one of the components chosen among the at least one movable gripper, the rotatable grip means 10 and the means for coupling the wheel 18 and the retention unit 11 comprises surfaces for contact with the product A, with the optional interposition of said sheet B, which have a predefined deformability, of the type of an elastomer, a polymeric foam and the like.

This ensures that even during the clamping of the product A the component does not deform said product A and does not deform its outer surfaces.

More particularly, it is noted that the surfaces of contact with the product A of at least one component chosen between the at least one movable gripper, the rotatable grip means, the locking unit 11 and the coupling means of the wheel 18 can comprise at least one sucker.

Advantageously, therefore, the present invention solves the problems described earlier, proposing the assembly 1 for the packaging of products A that is suitable to provide a wrapper that isolates completely the product from the outside environment, eliminating the risk of contamination caused, for example, by the passage of air from the inside to the outside of the wrapper and/or vice versa.

As shown previously, this is possible preferentially by adopting covering sheets B provided with an adhesive substance D along predefined portions of their flaps C.

In relation to the adoption of heated contoured plates 8, by using sheets B made of thermoplastic material it would in any case be possible to obtain the same result by means of a process for heat-sealing the bundle 7 of flaps C.

Furthermore, it has already been shown that the presence of the heated plates 8 is extremely useful also if a sheet B provided with adhesive substance D (or equivalent) is processed, since the thermal energy that is transferred to the bundle 7 during its compression facilitates the correct diffusion and distribution of said adhesive substance and in many cases contributes also to accelerate its cross-linking (and therefore the consolidation of the coupling of the flaps C provided thereby).

Usefully, the assembly 1 for packaging products A according to the invention is suitable to provide wrappers that have a high-value appearance and high quality standards by way of the presence of the many refinements described previously, intended to maintain ideal alignments of the flaps C during packaging.

Advantageously, the unit 1 provides a package that has means or other seals that show with assurance any tampering or opening of the provided package (such as for example the label 16).

Validly, the assembly 1 provides a wrapper, even partially similar to those of the known type, by adopting a technical and structural architecture that is alternative to that of known types of packaging machine.

Effectively, the assembly 1 has substantially modest embodiment costs and is relatively simple to provide in practice: these characteristics make it a packaging assembly that is safe in application.

The invention thus conceived is susceptible of numerous modifications and variations, all of which are within the scope of the appended claims; furthermore, all the details may be replaced with other technically equivalent elements.

For example, it is possible to provide for the presence of specific edges suitable to provide contoured incisions on the flaps C of the sheet B.

These edges, which are integral with the pusher 5, create a V-shaped incision on the flaps C in order to facilitate the coupling of said flaps C (for example gluing by means of the adhesive substance D), preventing the creation, on the flaps folded onto the protrusions 12, of a coupling discontinuity (region in which adhesive bonding is not complete), which might allow circulation of air from the inside to the outside of the package and vice versa.

In the exemplary embodiments shown, individual characteristics, given in relation to specific examples, may actually be interchanged with other different characteristics that exist in other exemplary embodiments.

In practice, the materials used, as well as the dimensions, may be any according to requirements and to the state of the art.

The disclosures in European Patent Application No. 15425041.9 and European Patent Application No. 15183991.7 from which this application claims priority are incorporated herein by reference.

The invention claimed is:

1. An assembly for packaging a product comprising at least one line for supplying said product to be packaged, at least one dispenser of a sheet configured to cover said product, a plurality of handling devices for juxtaposing said sheet on said product, and at least one output line for said product covered with said sheet, and wherein said handling devices comprise:

at least one pusher for a translation of said product along a trajectory that is incident to said sheet aligned therewith and with contrasts for folding said sheet on said product;

at least one pair of clamping jaws configured to juxtapose mutually opposite flaps of said sheet from a configuration of maximum mutual separation to a configuration of contact to form juxtaposed flaps of said sheet, surfaces of said clamping jaws that abut against said sheet having a complementarily shaped embossing for a penetration of raised portions of one jaw in complementarily shaped recesses of an other jaw, with an interposition of said mutually opposite flaps;

at least one abutment for folding portions of said juxtaposed flaps that are arranged at sides of said product, with consequent alignment of said juxtaposed flaps with one face of said product so as to constitute a bundle of gathered flaps;

at least one contoured clamping plate for transverse compaction of said bundle of gathered flaps, said at least one contoured clamping plate being provided with at least one heater for a controlled increase of temperature of said at least one contoured clamping plate, wherein said at least one contoured clamping plate is two in number, are substantially mutually opposite and are both configured to move from a configuration of maximum mutual separation to a configuration of at least partial juxtaposition, in which said bundle of gathered flaps is interposed and clamped between corresponding perimetric regions of said contoured clamping plates; and downstream of said at least one clamping plate provided with said at least one heater, a labeling unit provided with at least one apparatus for picking up and gluing a label, said apparatus for picking up and gluing said label being movable from a first configuration for picking up said label from a respective dispenser in which said label is aligned with said dispenser, to a second configuration for application of the label on the bundle of gathered flaps in which said label is aligned with said bundle of gathered flaps, surfaces for accommodating the label of said apparatus for picking up and gluing said label comprising a plurality of complementary and mated protrusions and recesses, during clamping of said label on the bundle of gathered flaps each protrusion of a first surface being accommodated at least partially within a respective recess of a second surface.

2. The assembly according to claim 1, wherein said at least one contoured clamping plate has a recess that comprises a substantially V-shaped end edge, which faces said bundle of gathered flaps, said perimetric regions being defined substantially at the vertex of said V-shaped end edge.

3. An assembly for packaging a product comprising at least one line for supplying said product to be packaged, at least one dispenser of a sheet configured to cover said product, a plurality of handling devices for juxtaposing said sheet on said product, and at least one output line for said product covered with said sheet, and wherein said handling devices comprise:

at least one pusher for a translation of said product along a trajectory that is incident to said sheet aligned therewith and with contrasts for folding said sheet on said product;

at least one pair of clamping jaws configured to juxtapose mutually opposite flaps of said sheet from a configuration of maximum mutual separation to a configuration of contact to form juxtaposed flaps of said sheet, surfaces of said clamping jaws that abut against said sheet having a complementarily shaped embossing for a penetration of raised portions of one jaw in complementarily shaped recesses of an other jaw, with an interposition of said mutually opposite flaps;

at least one abutment for folding portions of said juxtaposed flaps that are arranged at sides of said product, with consequent alignment of said juxtaposed flaps with one face of said product so as to constitute a bundle of gathered flaps;

at least one contoured clamping plate for transverse compaction of said bundle of gathered flaps, said at least one contoured clamping plate being provided with at least one heater for a controlled increase of temperature of said at least one contoured clamping plate, wherein said at least one contoured clamping plate is two in number, are substantially mutually opposite and are both configured to move from a configuration of maximum mutual separation to a configuration of at least partial juxtaposition, in which said bundle of gathered flaps is interposed and clamped between corresponding perimetric regions of said contoured clamping plates;

rotatable grip means, which face said bundle of gathered flaps, for clamping a free end of said bundle of gathered flaps and said rotatable grip means rotates with respect to said product covered by a remaining portion of said sheet, with consequent further compaction of at least one part of said bundle of gathered flaps; and downstream of said at least one contoured clamping plate provided with said at least one heater, a labeling unit provided with at least one apparatus for picking up and gluing a label, said apparatus for picking up and gluing said label being movable from a first configuration for picking up said label from a respective dispenser in which said label is aligned with said dispenser, to a second configuration for application of the label on the bundle of gathered flaps in which said at least one label is aligned with said bundle of gathered flaps, surfaces for accommodating the label of said apparatus for picking up and gluing said label comprising a plurality of complementary and mated protrusions and recesses, during clamping of said label on the bundle of gathered flaps each protrusion of a first surface being accommodated at least partially within a respective recess of a second surface.

4. An assembly for packaging a product comprising at least one line for supplying said product to be packaged, at least one dispenser of a sheet configured to cover said product, a plurality of handling devices for juxtaposing said sheet on said product, and at least one output line for said product covered with said sheet, and wherein said handling devices comprise:

a pusher for a translation of said product along a trajectory that is incident to said sheet aligned therewith and with contrasts for folding said sheet on said product;

at least one pair of clamping jaws configured to juxtapose mutually opposite flaps of said sheet from a configuration of maximum mutual separation to a configuration of contact to form juxtaposed flaps of said sheet, surfaces of said clamping jaws that abut against said sheet having a complementarily shaped embossing for a penetration of raised portions of one jaw in complementarily shaped recesses of an other jaw, with an interposition of said jutaposed flaps;

at least one abutment for folding portions of said juxtaposed flaps that are arranged at sides of said product, with consequent alignment of said mutually opposite flaps with one face of said product so as to constitute a bundle of gathered flaps;

at least one contoured clamping plate for transverse compaction of said bundle of gathered flaps, said at least one contoured clamping plate being provided with at least one heater for a controlled increase of temperature of said at least one contoured clamping plate, wherein said at least one contoured clamping plate is two in number, are substantially mutually opposite and are both configured to move from a configuration of maximum mutual separation to a configuration of at least partial juxtaposition, in which said bundle of gathered flaps is interposed and clamped between corresponding perimetric regions of said contoured clamping plates, wherein said pusher is contoured and comprises a unit for retaining the product, which is arranged substantially at a centreline of said pusher and is provided with laminar lateral protrusions for an alignment of lateral flaps of the sheet during crossing of said contrasts; and downstream of said at least one contoured clamping plate provided with said at least one heater, a labeling unit provided with at least one apparatus for picking up and gluing a label, said apparatus for picking up and gluing said label being movable from a first configuration for picking up said label from a respective dispenser in which said label is aligned with said dispenser, to a second configuration for application of the label on the bundle of gathered flaps in which said label is aligned with said bundle of gathered flaps, surfaces for accommodating the label of said apparatus for picking up and gluing said label comprising a plurality of complementary and mated protrusions and recesses, during clamping of said label on the bundle of gathered flaps each protrusion of a first surface being accommodated at least partially within a respective recess of a second surface.

5. The assembly according to claim 1, wherein said surfaces of said clamping jaws comprise a plurality of consecutive and alternating ridges and grooves, each ridge of the surface of a first jaw being aligned with a respective groove of the surface of a second jaw, each groove of the surface of a first jaw being aligned with a respective ridge of the surface of the second jaw.

6. The assembly according to claim 5, wherein said surfaces of said clamping jaws are made of one of a material selected from the group consisting of an elastomer and a polymer.

7. The assembly according to claim 1, further comprising at least one transfer wheel that is provided, on a substantially perimetric edge thereof, with coupling means for said product covered by said sheet, said product being arranged with said bundle of gathered flaps directed radially outward.

8. The assembly according to claim 1, wherein at least one component chosen among a rotatable grip means, a retention unit and coupling means of a wheel comprises surfaces for contact with said product, which have a predefined deformability, of an elastomer.

9. The assembly according to claim 7, wherein a surface of contact of at least one component chosen among rotatable grip means, a retention unit and said coupling means of said wheel with said product comprises at least one sucker.

10. The assembly according to claim 1, wherein said at least one abutment, for folding portions of said juxtaposed flaps arranged at sides of said product, with consequent alignment of said juxtaposed flaps with a face of said product so as to constitute the bundle of gathered flaps, comprises two elements, which can slide parallel to a partially packaged product for the conveyance of the bundle of gathered flaps.

* * * * *